US005515971A

United States Patent [19]

Segrest

[11] Patent Number: 5,515,971

[45] Date of Patent: May 14, 1996

[54] APPARATUS FOR TRANSPORTING LAMP BULBS

[76] Inventor: Edward J. Segrest, 14527 Catalina Cir., Seminole, Fla. 34646

[21] Appl. No.: 406,539

[22] Filed: Mar. 20, 1995

[51] Int. Cl.[6] ..... B65D 85/42

[52] U.S. Cl. ..... 206/418; 206/446; 206/591; 206/594; 206/815

[58] Field of Search ..... 206/443, 446, 206/418, 523, 591, 593, 594, 815

[56] References Cited

U.S. PATENT DOCUMENTS

| | | | |
|---|---|---|---|
| 1,611,575 | 12/1926 | Aulbach | 206/418 |
| 2,125,312 | 8/1938 | Ringler | 206/418 |
| 2,330,346 | 9/1943 | Elliott | 206/418 |
| 2,956,687 | 10/1960 | Robichaud | 206/523 |
| 3,187,886 | 6/1965 | Honey | 206/523 |
| 4,662,535 | 5/1987 | Loveland | 206/418 |
| 4,834,239 | 5/1989 | Osgood | 206/418 |
| 4,964,529 | 10/1990 | Houston | 206/523 |

FOREIGN PATENT DOCUMENTS

| | | | |
|---|---|---|---|
| 548781 | 10/1942 | United Kingdom | 206/418 |

*Primary Examiner*—Paul T. Sewell
*Assistant Examiner*—Marie Denise Patterson

[57] ABSTRACT

An apparatus for transporting lamp bulbs such as a fluorescent tube includes a central housing assembly, a finger access port through which a finger can be inserted to partially push a retained fluorescent tube out of the apparatus is located on one end of the housing assembly and a first resilient or cushioning member located inside the housing adjacent the access port. A cap assembly is removably connected to a second opposed end of the central housing assembly. A compressible gripper assembly in the form of a resilient donut or ring is connected to an interior surface of the central housing assembly proximal to the first resilient member and has an uncompressed internal diameter which is less than an outer tube diameter of a fluorescent tube adapted to be retained in the apparatus by the gripper assembly. A filter member is provided coextensive with the access port between the first resilient member and the gripper assembly. The removable cap assembly includes a second resilient or cushioning member adapted to resiliently engage the second opposed end of a fluorescent tube retained within the central housing assembly by the gripper assembly.

15 Claims, 3 Drawing Sheets

APPARATUS FOR TRANSPORTING LAMP BULBS

BACKGROUND OF THE INVENTION

1. Field of the Invention

The present invention relates generally to devices for transporting electric light sources containing glass envelopes (e.g. lamp bulbs) and, more particularly, to devices especially adapted for transporting fluorescent tubes.

2. Description of the Prior Art

Electric light sources often contain a source of illumination contained within a glass envelope. Conventionally, to protect the glass envelope from breaking during transport, the electric light sources is packaged in a soft, paper container. The soft, paper container serves to provide some cushioning against mild shock. However, the soft, paper container does not have sufficient strength to withstand even a mild blow without buckling and permitting the glass envelope to break. In this respect, it would be desirable for a container for an electric light source which contains a glass envelope to be able to withstand mild blows without buckling and permitting the glass envelope to break.

Of special interest are fluorescent and high-intensity discharge (HID) lamps because they contain mercury, lead and sometimes cadmium. Not only should such lamps be protected from damage before they are placed in use, but they should also be protected from damage after they have burned out (hereinafter such lamps are referred to as "fluorescent tubes"). More specifically, when fluorescent tubes are burned out, they must be disposed of. Yet, their disposal provides a number of problems. First, when a fluorescent tube breaks, there is the danger of a large number of glass fragments spreading over a considerable area. Personnel can be injured, and areas around a broken fluorescent tube can be made hazardous from broken glass. In this respect, it would be desirable for a container to be provided to prevent a burned out fluorescent tube from breaking and spreading a large number of glass fragments over a considerable area.

Aside from the concerns of broken glass fragments, the disposal and breaking of burned out fluorescent tubes involves the potential release of mercury (or other toxic metals) to the environment. A quantity of mercury is confined to the interior of the glass envelope of a fluorescent tube. Once the glass envelope is broken, the mercury can escape into the environment. However, the environment must be protected from mercury pollution. Some laws are presently in force which prohibit or severely restrict the release of mercury and toxic metals into the environment. In this respect, it would be desirable for a container for a fluorescent tube to prevent a release of mercury into the environment in the event that the fluorescent tube breaks while in the container.

By adequately protecting the environment from pieces or particles resulting from breakage of fluorescent tubes, both the transporter of the fluorescent tubes and third parties are protected. In this way, the transporter of the fluorescent tubes is protected in a legal sense from liability claims of third parties.

Fluorescent tubes come in a variety of sizes and shapes. In this respect, it would be desirable if a fluorescent tube carrier could accommodate fluorescent tubes having a variety of sizes and shapes.

When a fluorescent tube is carried within a container, it is desirable for the fluorescent tube to be cushioned within the container. The cushioning helps prevent internal movement and breakage of the fluorescent tubes inside the container when the container is subjected to jostling and impact.

Generally speaking, when it is time to remove an object from a container, sometimes the object tends to stick inside the container. Sometimes, the container must be inverted and shaken in order that the object contained inside will fail out of the container. Such a procedure may be extremely difficult to carry out for relatively elongated fluorescent tubes contained in even elongated tubular containers. In this respect, it would be desirable for a container for fluorescent tubes to be provided with a way to readily urge a fluorescent tube out of the container without needing to invert and shake the container.

Another way to solve the problem of an object tending to stick inside a container is to grasp the object in one hand, to grasp the container in the other hand, and to pull the two apart. Often however, the object fits snugly in the container, and it is difficult to maneuver one's fingers or hand around the object. Initially, the hope is to pull an end portion of the object out of the container with one's fingers so that enough of the object will be exposed to enable a person's hand to firmly grasp the object to pull the remainder of the object out the container. More specifically with respect to fluorescent tubes, for a fluorescent tube that fits so snugly inside a container that it is difficult to insert one's fingers into the container around the fluorescent tube in order to pull an end portion of the fluorescent tube out of the container, it would be desirable if the container were provided with a way to move an end portion of the fluorescent tube out of the container without requiring a person's fingers to grasp and pull the end portion of the fluorescent tube out of the container.

In the event that a fluorescent tube breaks while inside a container, the normal vacuum of the tube creates a momentary pressure differential between the inside and the outside of the container. In this respect, it would be desirable for a container for a fluorescent tube to be provided with a way to equalize the pressure differential between the inside and the outside of the container when the fluorescent tube accidentally breaks inside the container.

Containers that are to be used for transporting burned out fluorescent tubes to recycling centers are going to be used over and over again. In this respect, it would be desirable for such a container to have features that enable the container to be readily loaded and unloaded over and over again.

Throughout the years, a number of innovations have been developed relating to storage and disposal of cylindrical objects such as fluorescent tubes, and the following U.S. and foreign patents are representative of some of those innovations: U.S. Pat. Nos. 2,638,022, 3,623,672, 4,579,287, 4,662,535, 4,714,162, 4,953,701, and 5,351,896; and French Patent 1,098,693. More specifically, U.S. Pat. No. 2,638,022 relates to a device for breaking ampoules. U.S. Pat. Nos. 3,623,672, 4,579,287, 4,662,535, 4,953,701, and 5,351,896 disclose devices designed for breaking fluorescent tubes prior to disposal. U.S. Pat. No. 4,714,162 discloses a carrier for fluorescent tubes, and French Patent 1,098,693 also appears to disclose a carrier for fluorescent tubes. None of the prior art provide the desirable features discussed above.

Thus, while the foregoing body of prior art indicates it to be well known to use containers to store and dispose of fluorescent tubes, the prior art described above does not teach or suggest a fluorescent tube transport apparatus which has the following combination of desirable features: (1) provides a container for an electric light source which contains a glass envelope wherein the container is able to withstand mild blows without buckling and without permitting the glass envelope to break; (2) prevents a broken fluorescent tube from spreading a large number of glass fragments over a considerable area; (3) prevents a release of mercury into the environment in the event that a fluorescent tube breaks while in the container; (4) can accommodate fluorescent tubes having a variety of cylindrical radii; (5) provides retention means inside the container to prevent the fluorescent tube from moving around while retained inside the central housing assembly, and accidentally falling out of the central housing assembly in an uncontrolled manner; (6) provides a container having a way for readily urging a fluorescent tube out of the container without needing to invert and shake the container; (7) provides a container having a way for readily urging an end portion of a fluorescent tube out of the container without requiring a person's fingers to grasp and pull the end portion of the fluorescent tube out of the container; (8) has means for equalizing any pressure differential between the inside and the outside of the container; and (9) has features that enable the container to be readily loaded and unloaded over and over again. The foregoing desired characteristics are provided by the unique fluorescent tube transport apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a fluorescent tube transport apparatus for retaining a fluorescent tube that has an outer tube diameter. The fluorescent tube transport apparatus includes a central housing assembly which has an inner dimension which is greater than the outer tube dimension. The central housing assembly includes a first end and a second end, and a first cap assembly is connected to the first end of the central housing assembly. The first cap assembly includes an access port for permitting access to inside the first cap assembly from outside the first cap assembly. A second cap assembly is removably connected to the second end of the central housing assembly.

A compressible gripper assembly is connected to an interior surface proximal to one end of the central housing assembly. The gripper assembly is in the form of a resilient donut or ring having a normally uncompressed internal diameter. The normal or uncompressed internal diameter of the gripper assembly is less than the outer tube dimension or diameter of the fluorescent tube to be retained in the central housing assembly.

The access port has an inner port diameter which is sufficiently large to easily enable a person's finger to be inserted through the access port. The first cap assembly includes a quantity of first cushion material attached to an inside surface of the first cap assembly such that the first cushion material exerts a resilient force longitudinal force on a first end portion of a fluorescent tube when the fluorescent tube is retained within the central housing assembly and more particularly, is inserted into the bore of the gripper assembly. The first cap assembly includes a far end portion, and a side wall portion is connected to the far end portion. The first cap assembly further includes a flexible filter element coextensively positioned with respect to the access port.

The second cap assembly includes a quantity of second cushion material attached to an inside surface of the second cap assembly such that the second cushion material resiliently engages a second opposed end portion of a fluorescent tube when the fluorescent tube is retained within the central housing assembly (and the gripper assembly). The second cushion material is inserted inside a portion of the central housing assembly when the second cap assembly is attached to the central housing assembly. The second cap assembly includes a far end portion and a side wall portion connected to the far end portion.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for transporting lamp bulbs which has all of the advantages of the prior art and none of the disadvantages.

It is another object of the present invention to provide a new and improved apparatus for transporting lamp bulbs which may be easily and efficiently manufactured and marketed.

It is a further object of the present invention to provide a new and improved apparatus for transporting lamp bulbs which is of durable and reliable construction.

An even further object of the present invention is to provide a new and improved apparatus for transporting lamp bulbs which is susceptible of a low cost of manufacture with regard to both materials and labor, and which accordingly is then susceptible of low prices of sale to the consuming public, thereby making such fluorescent tube transport apparatus available to the buying public.

Still yet a further object of the present invention is to provide a new and improved transport apparatus which provides a container for an electric light source which contains a glass envelope wherein the container is able to withstand mild blows without buckling and without permitting the glass envelope to break.

Still another object of the present invention is to provide a new and improved fluorescent tube transport apparatus that prevents a broken fluorescent tube from spreading a large number of glass fragments over a considerable area.

Yet another object of the present invention is to provide a new and improved fluorescent tube transport apparatus which prevents a release of mercury into the environment in the event that a fluorescent tube breaks while in the transport apparatus.

Even another object of the present invention is to provide a new and improved fluorescent tube transport apparatus that can accommodate fluorescent tubes having a variety of cylindrical radii.

Still a further object of the present invention is to provide a new and improved fluorescent tube transport apparatus which provides cushioning for the fluorescent tube within the transport apparatus and prevents a fluorescent tube inserted therein from accidentally falling out in an uncontrolled manner.

Yet another object of the present invention is to provide a new and improved fluorescent tube transport apparatus that provides a container having a way for readily urging a fluorescent tube out of the container without needing to invert and shake the container.

Still another object of the present invention is to provide a new and improved fluorescent tube transport apparatus which provides a container having a way for readily urging an end portion of a fluorescent tube out of the container without requiring a person's fingers to grasp and pull the end portion of the fluorescent tube out of the container.

Yet another object of the present invention is to provide a new and improved fluorescent tube transport apparatus that has a way to substantially immediately equalize any momentary pressure differential between the inside and the outside of the transport apparatus caused when a fluorescent tube breaks.

Still a further object of the present invention is to provide a new and improved fluorescent tube transport apparatus that has features that enable the transport apparatus to be readily loaded and unloaded over and over again.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
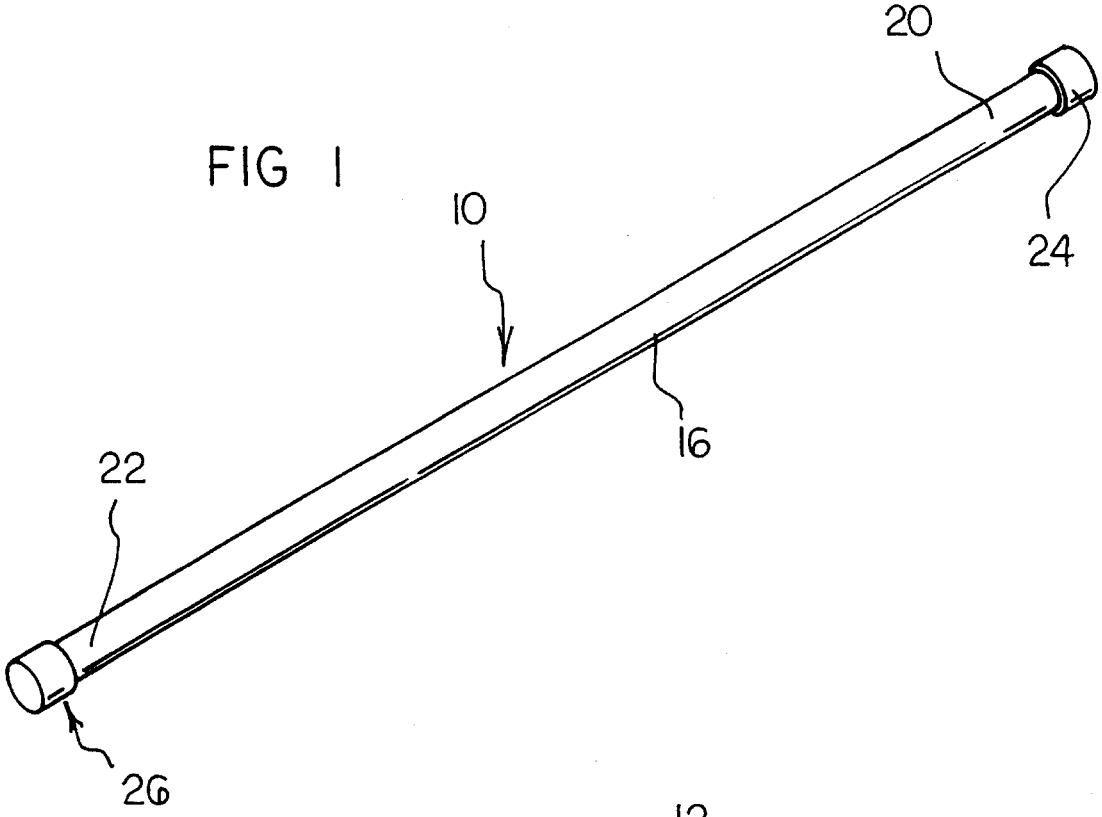
FIG. 1 is a perspective view showing a preferred embodiment of the apparatus for transporting lamp bulbs according to the invention in a closed condition.
Figure 2:
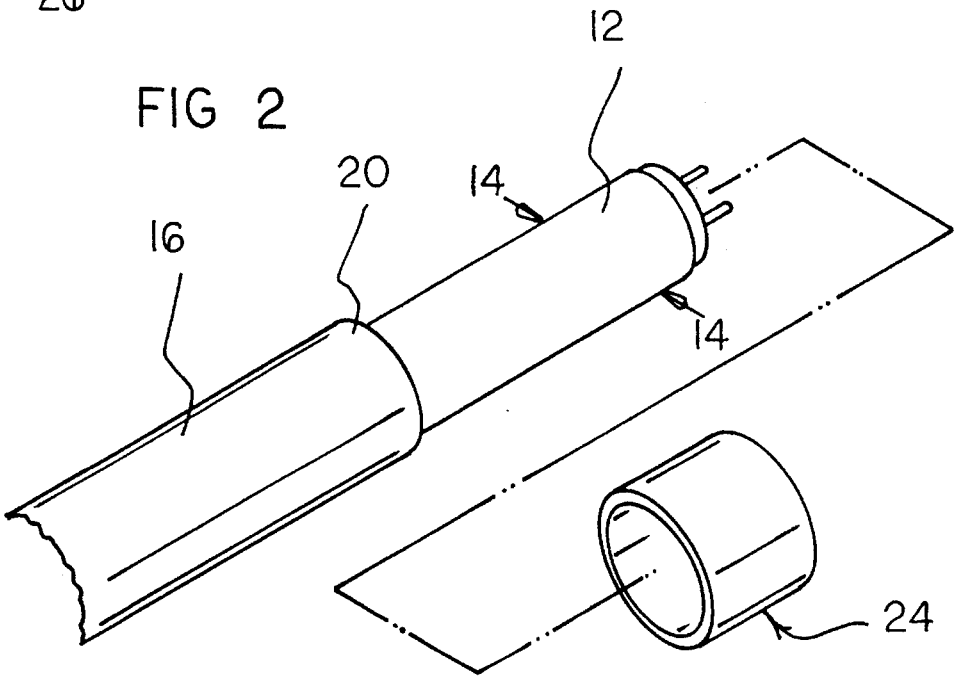
FIG. 2 is an enlarged, partially exploded, partial perspective view of a first end of the embodiment of the invention shown in FIG. 1.

With reference to the drawings, a new and improved apparatus for transporting lamp bulbs embodying the principles and concepts of the present invention will be described.

Turning to FIGS. 1–6, there is shown an exemplary embodiment of the present invention generally designated by reference numeral 10. In its preferred form, lamp bulb transport apparatus 10 is especially adapted for retaining a conventional fluorescent tube 12 that has an outer tube diameter 14. The fluorescent tube transport apparatus 10 includes a central housing assembly 16 which has an inner dimension or diameter 18 which is greater than the outer tube diameter 14. The central housing assembly 16 includes a first end 20 and a second end 22, and a first cap assembly 24 is connected to the first end 20 of the central housing assembly 16. The first cap assembly 24 includes an access port 28 for permitting access to inside the first cap assembly 24 from outside the first cap assembly 24. A second cap assembly 26 is connected to the second end 22 of the central housing assembly 16.

A compressible gripper assembly 42 is connected to an interior surface of one end of the central housing assembly 16. The gripper assembly 42 has an uncompressed internal diameter 44. The uncompressed internal diameter 44 of the gripper assembly 42 is less than the outer tube diameter 14 of the fluorescent tube 12. When the fluorescent tube 12 is retained in the fluorescent tube transport apparatus 10 of the invention, the fluorescent tube 12 compresses the gripper assembly 42 so that the gripper assembly 42 has a compressed internal diameter 45 which is equal to the outer tube diameter 14 of the fluorescent tube 12.

The access port 28 has an inner port diameter 30 which is sufficiently large to enable a person's finger 32 to be inserted through the access port 28. The first cap assembly 24 includes a quantity of first cushion material 25 attached to an inside surface of the first cap assembly 24 such that the first cushion material 25 exerts a longitudinal force on a first end portion of a fluorescent tube 12 when the fluorescent tube 12 is retained within the central housing assembly 16. The first cap assembly 24 includes a far end portion 34, and a side wall portion 36 is connected to the far end portion 34.

Figure 3:
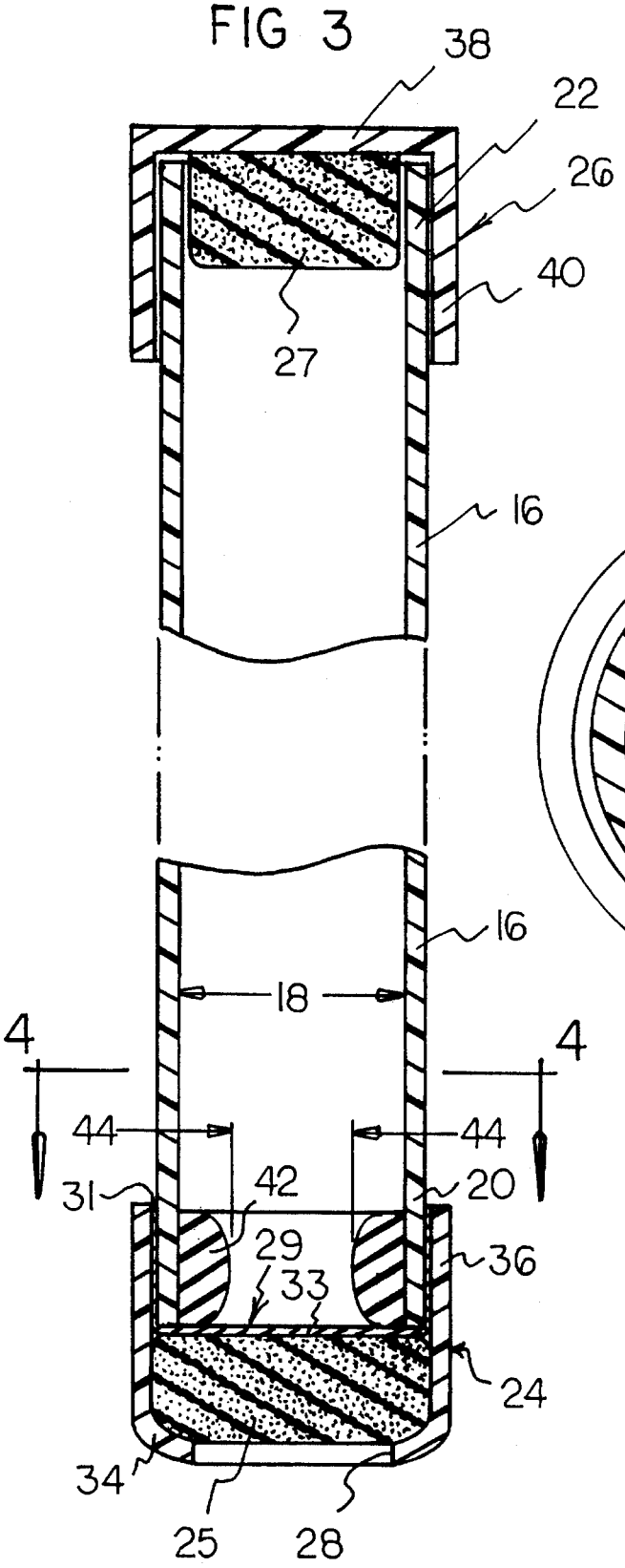
FIG. 3 is an enlarged, partially compressed, longitudinal cross-sectional view of the embodiment of the invention of FIG. 1 without containing a fluorescent tube.
Figure 4:
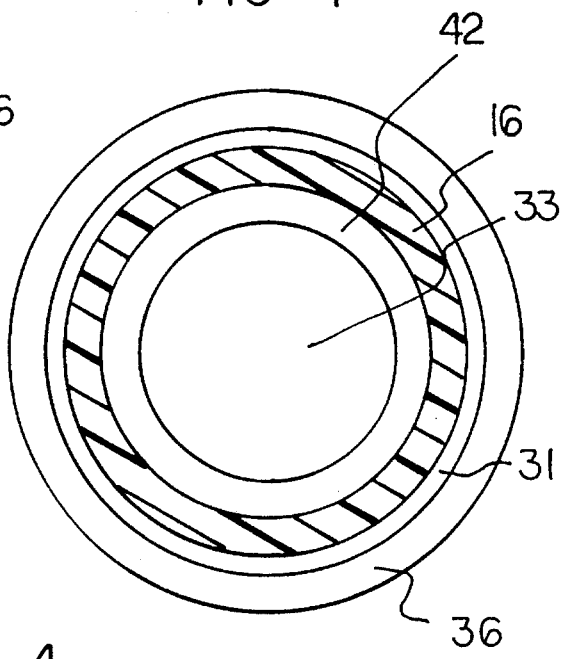
FIG. 4 is an enlarged, transverse cross-sectional view of the embodiment of the invention shown in FIG. 3 taken along line 4—4 of FIG. 3.

The first cap assembly 24 further includes a filter element 29 in the form of a relatively thin, flexible layer of filter material. The filter element or material 29 can be supported by the first cushion material 25. The side wall portion 36 of the first cap assembly 24 is adapted to provide a friction fit between the first cap assembly 24 and the first end 20 of the central housing assembly 16. More specifically, as shown in FIG. 3, a peripheral portion 31 of the filter material 29 is squeezed between the side wall portion 36 of the first cap assembly 24 and the first end 20 of the central housing assembly 16. In addition, the filter material 29 includes a filtering portion 33 which is interposed between the interior of the central housing assembly 16 and the first cushion material 25 as shown in FIG. 3.

The second cap assembly 26 includes a quantity of second cushion material 27 attached to an inside surface of the second cap assembly 26 such that the second cushion material 27 contacts a second end portion of a fluorescent tube 12 when the fluorescent tube 12 is retained within the central housing assembly 16. The second cushion material 27 is inserted inside a portion of the central housing assembly 16 when the second cap assembly 26 is attached to the central housing assembly 16 substantially as shown in FIG. 3. It will be noted that the second cap assembly 26 is removably attachable to its corresponding end of the central housing assembly to facilitate loading and unloading of fluorescent tubes therein.

The second cap assembly 26 includes a far end portion 38 and a side wall portion 40 connected to the far end portion 38. The side wall portion 40 of the second cap assembly 26 in its preferred form is adapted to form a friction fit with the outer surface of the second end 22 of the central housing assembly 16. Preferably, the frictional fit between second cap assembly 26 and the end of the central housing assembly to which it is adapted to be removably attached is sufficient to securely maintain the central housing assembly securely sealed during transport and handling, yet permit removal thereof by hand manipulation when desired. Alternatively, as will occur to those skilled in the art, other means may be employed instead to removably attach the second end cap assembly to the end of the central housing assembly such as complimentary mating threaded surfaces, complimentary mating snap fitments, or the like.

In using the fluorescent tube transport apparatus 10 of the invention, the second cap assembly 26 is pulled off of the second end 22 of the central housing assembly 16. The second cap assembly 26 fits onto the second end 22 of the central housing assembly 16 by of a friction fit between the side wall portion 40 of the second cap assembly 26 and the outer surface of the second end 22 of the central housing assembly 16. Once the second cap assembly 26 is removed from the central housing assembly 16, a fluorescent tube 12 is lowered into the central housing assembly 16.

Figure 5:
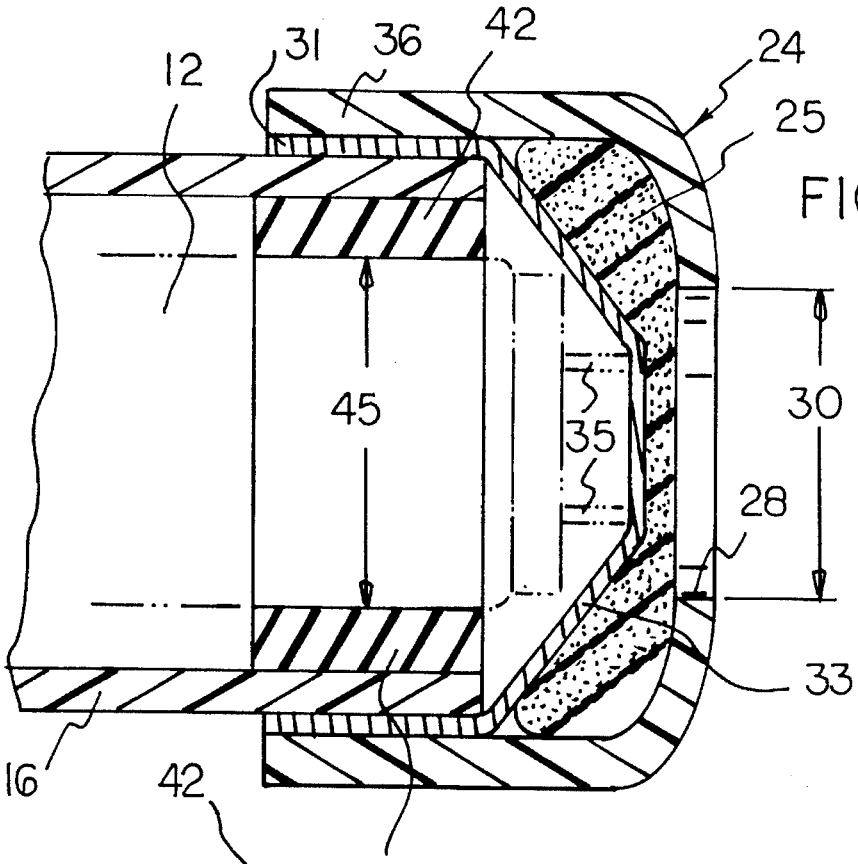
FIG. 5 is an enlarged partial cross-sectional view of the first end of the embodiment of the invention shown in FIG. 3 with a fluorescent tube completely contained inside the apparatus.

Before an end of the fluorescent tube 12 arrives in the vicinity of the first cap assembly 24, the gripper assembly 42 is in an uncompressed state as shown by uncompressed internal diameter 44. As the end of the fluorescent tube 12 moves axially and approaches the first cap assembly 24 inside the central housing assembly 16, two events take place. As shown in FIG. 5, the prongs 35 of the fluorescent tube 12 press up against the filtering portion 33 of the filter material 29 and cause the longitudinal portion of the first cushion material 25 to be compressed. In addition, the fluorescent tube 12 fills the bore of the gripper assembly 42 and resiliently compresses it causing the gripper assembly 42 inner dimension or diameter to enlarge until it is equal to the outer tube diameter 14 of the fluorescent tube 12. The inner dimension or diameter of gripper assembly 42 in such enlarged state is denoted by reference sign 45. Once the fluorescent tube 12 is positioned inside the central housing assembly 16 as shown in FIG. 5, the second cap assembly 26 is fixed in place on the second end 22 of the central housing assembly 16. In this condition of arranged parts, and in accordance with the invention, the second cushion material 27 presses up against the proximal end of the fluorescent tube 12, the gripper assembly 42 resiliently and circumferentially grips the tube, and the filter material 29 and the first cushion material 25 resiliently engages the tube at its distal end. By this action, the fluorescent tube 12 may be securely resiliently supported inside the central housing assembly and safely stored for transportation to a suitable disposal site.

Figure 6:
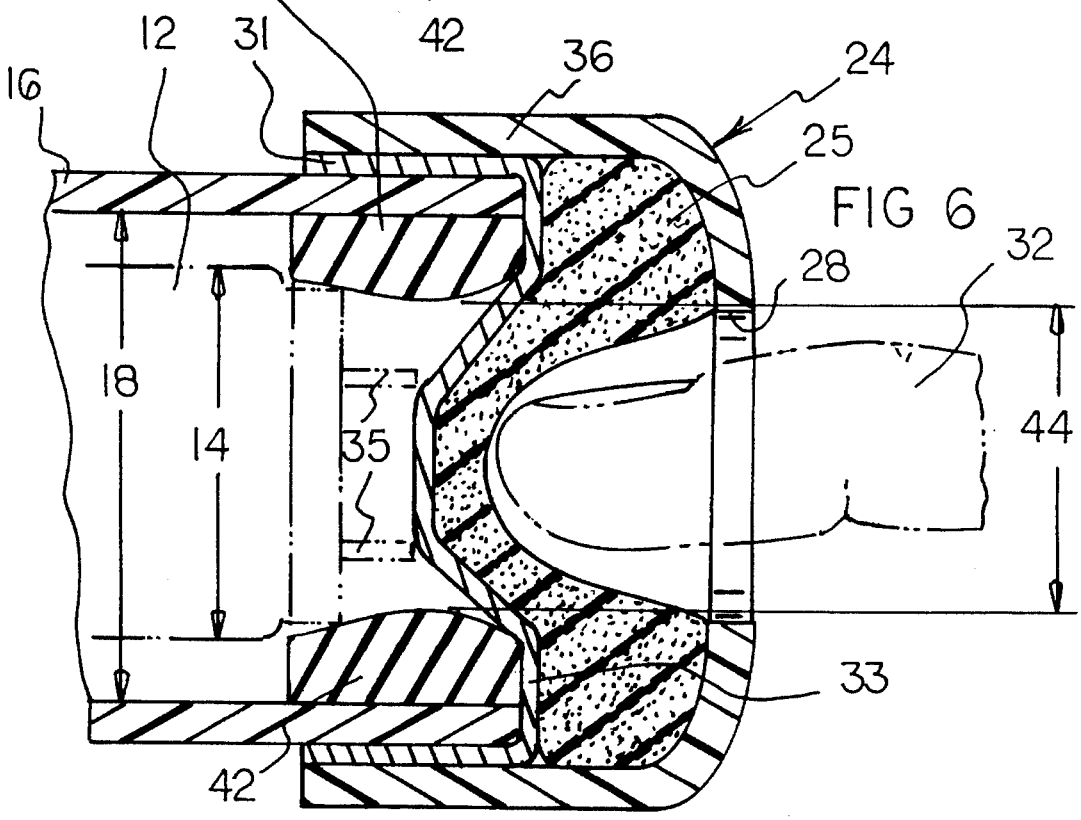
FIG. 6 is a view of the embodiment of the invention shown in FIG. 5 with a person's finger being used to push on one end of the fluorescent tube in order to move a portion of the opposite end (not shown) of the fluorescent tube out of the apparatus.

When it is desired to remove the fluorescent tube 12 from the fluorescent tube transport apparatus 10, the second cap assembly 26 is first removed from the central housing assembly 16. Then, as shown in FIG. 6, a person inserts a finger 32 through the access port 28. In doing so, the person's finger 32 presses up against the longitudinal portion of the first cushion material 25, which, in turn, presses up against the filtering portion 33 of the filter material 29, which, in turn, presses up against the prongs 35 of the fluorescent tube 12. This causes the fluorescent tube 12 to be pushed longitudinally away from the gripper assembly 42 in a direction parallel to the longitudinal central axis of the central housing assembly so that the gripper assembly 42 releases its grip of the fluorescent tube 12. Once the fluorescent tube 12 has been released from the grip of the gripper assembly 42, the opposite end of the fluorescent tube 12 projects out from the central housing assembly 16 and can be grasped by a person's hand so that the fluorescent tube 12 can be completely pulled out of the central housing assembly 16 for use or disposal. To use the fluorescent tube transport apparatus 10 for another fluorescent tube 12, the process is repeated.

The fluorescent tube transport apparatus 10 of the invention can be made in a variety of lengths to accommodate a variety of fluorescent tubes. For example, the fluorescent tube transport apparatus 10 can be of sufficient lengths to accommodate 4 feet, 6 feet, and 8 feet long fluorescent tubes. In addition, a case can be provided for holding and transporting a plurality of fluorescent tube transport apparatus 10 of the invention. Also, it will be appreciated that the cross-sectional shape of the transport apparatus 10 and/or its overall shape may be altered to accommodate any size and shape of fluorescent bulb without departing from the principles of the invention, e.g. a U-shaped central housing assembly having a rectangular shaped cross-sectional shape may be employed with a rectangular shaped second end cap to safely store and transport U-shaped fluorescent light bulbs. Finally, it will be appreciated that the apparatus of the present invention may be utilized to safely transport lamp bulbs other than fluorescent or HID lamps such as incandescent, halogen, neon and so on.

The flexible filter element 29 serves to trap particulates that may be released when a fluorescent tube 12 breaks while inside the fluorescent tube transport apparatus 10. Furthermore, the filter element 29 can serve to retain any mercury, lead or cadmium that may be released if the fluorescent tube 12 breaks while inside the fluorescent tube transport apparatus 10. Furthermore, the filter element 29 in conjunction with the access port 28 serves as an air passage coextensive and proximal to the access port 28 to facilitate equalization of any pressure differential between the inside of the central housing assembly 16 and the outside of the fluorescent tube transport apparatus 10 in the event the tube being transported inside the central housing assembly breaks for any reason. The filter element 29 may be in the form of any strong, flexible air-pervious diaphragm with a woven fabric material sold under the Trademark SPANDEX being particularly preferred.

The first cushion material 25, the second cushion material 27, and the gripper assembly 42 can be made from cellular resilient material such as polyurethane foam. Alternate materials that can be used may be sponge rubber, felt, or other suitable material. The central housing assembly 16, the non-cushion portions of the first cap assembly 24, and the non-cushion portions of the second cap assembly 26 preferably are inexpensively be fabricated from polyvinyl chloride (PVC) tubing or other well known easily molded or formed plastic material. In this regard, the first end cap assembly may be molded integrally with the central housing assembly and the gripper assembly, the first cushion material and the filter element may be suitably attached interiorly after being inserted as a separately formed module.

In addition, the first cushion material 25 can also include an electro-static filter material or other filter material such as activated carbon. These materials can also serve to trap and retain mercury and particulate materials if a fluorescent tube 12 breaks. If desired, appropriate labels can be affixed to the outside of the fluorescent tube transport apparatus 10 to indicate the specific nature of the contents. For example, if the fluorescent tube 12 inside the fluorescent tube transport apparatus 10 has broken. A label can be affixed that indicates the presence therein of hazardous mercury.

It is contemplated that a plurality of fluorescent tube transport apparatuses of the invention can be transported together in a common unit. More specifically, a carrier unit can accommodate six fluorescent tube transport apparatuses of the invention. The carrier unit can carry any standard length tube, up to 8 feet, for example, or any combination of tube lengths.

The components of the fluorescent tube transport apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved apparatus for transporting lamp bulbs that is low in cost, relatively simple in design and operation, and which may advantageously be used to provide a container for an electric light source which contains a glass envelope wherein the container is able to withstand mild blows without buckling and without permitting the glass envelope to break. With the invention, a fluorescent tube transport apparatus is provided which prevents a broken fluorescent tube from spreading a large number of glass fragments over a considerable area. With the invention, a fluorescent tube transport apparatus is provided which prevents a release of mercury into the environment in the event that a fluorescent tube breaks while in the container. With the invention, a fluorescent tube transport apparatus is provided which can accommodate fluorescent tubes having a variety of cylindrical radii. With the invention, a fluorescent tube transport apparatus provides cushioned support and retention for the fluorescent tube within the container and prevents the tube from accidentally falling out in an uncontrolled manner. With the invention, a fluorescent tube transport apparatus provides a container having a way for readily urging a fluorescent tube out of the container without needing to invert and shake the container. With the invention, a fluorescent tube transport apparatus provides a container having a way for readily urging an end portion of a fluorescent tube out of the container without requiring a person's fingers to grasp and pull the end portion of the fluorescent tube out of the container. With the invention, a fluorescent tube transport apparatus is provided which has means for equalizing any momentary pressure differential between the inside and the outside of the container (caused when the tube inside accidentally breaks). With the invention, a fluorescent tube transport apparatus is provided which has features that enable the container to be readily loaded and unloaded over and over again.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. Apparatus for transporting a lamp bulb having an outer dimension, comprising:

a central housing assembly having an inner dimension, wherein said inner dimension is greater than the outer dimension such that said lamp bulb is adapted to be received within said housing assembly, and wherein said central housing assembly includes a first end and a second end, a first cap assembly on said first end of said central housing assembly, said first cap assembly including an access port for permitting access to inside said first cap assembly from outside said first cap assembly, and a second cap assembly connected to said second end of said central housing assembly, wherein said second cap assembly is selectively removable from said central housing assembly, a tube holding means comprising a compressible gripper assembly connected to an interior surface proximal to said first end of said central housing assembly, further including a filter coextensive with said access port between said access port and said compressible gripper assembly, and a resilient material between said access port and said filter.

2. The apparatus of claim 1, further including:

a compressible gripper assembly connected to an interior surface of one end of said central housing assembly.

3. The apparatus of claim 1 wherein said gripper assembly comprises an annular member of resilient material having an opening therethrough, said opening being expandable between a first diameter and a second diameter greater than said first diameter when a portion of said lamp bulb is received in said opening.

4. The apparatus of claim 3 wherein said first diameter of said annular member is less than the outer dimension of said portion of said lamp bulb when said portion of said lamp bulb is received in said opening.

5. The apparatus of claim 4 wherein said lamp bulb is a fluorescent tube and said outer dimension comprises the outer diameter of said portion of said lamp bulb.

6. The apparatus of claim 1 wherein said access port has a diameter which is sufficiently large to enable a person's finger to be inserted through said access port to engage said lamp bulb when said portion of said lamp bulb is received within said central housing assembly.

7. The apparatus of claim 1 wherein said first cap assembly includes a quantity of first cushion material attached to an inside surface of said first cap assembly such that said first cushion material exerts a resilient longitudinal force on a first end portion of a lamp bulb when the lamp bulb is retained within said central housing assembly.

8. The apparatus of claim 1 wherein said first cap assembly includes a far end portion and a side wall portion connected to said far end portion.

9. The apparatus of claim 1 wherein said first cap assembly further includes a filter.

10. The apparatus of claim 7 wherein said second cap assembly includes a quantity of second cushion material attached to an inside surface of said second cap assembly such that said second cushion material contacts a second end portion of said lamp bulb when the lamp bulb is retained within said central housing assembly.

11. The apparatus of claim 10 wherein said second cushion material is inserted inside a portion of said central housing assembly when said second cap assembly is attached to said central housing assembly.

12. The apparatus of claim 1 wherein said second cap assembly includes a far end portion and a side wall portion connected to said far end portion.

13. A fluorescent tube transport apparatus for retaining a fluorescent tube, said fluorescent tube having first and second opposed ends and a portion therebetween having an outer tube dimension, comprising:

a central housing assembly having an inner dimension, wherein said inner dimension is greater than the outer tube dimension of said fluorescent tube, and wherein said central housing assembly includes a first end and a second end, said first end of said central housing assembly including an access port for permitting access to inside said central housing assembly from outside thereof, tube holding means on an interior surface of said central housing assembly for holding said florescent tube when said fluorescent tube is received within said central housing assembly, wherein a fluorescent tube may be released from said tube holding means by the action of force applying means inserted through said access port to engage one of said first or second ends of said fluorescent tube therein to cause it to move through said second end of said central housing assembly;

including a filter coextensive with said access port between said access port and said tube holding means, and a resilient member between said access port and said filter.

14. The apparatus of claim 13, further including:

a removable cap assembly connected to said second end of said central housing assembly.

15. The apparatus of claim 1 wherein said access port is sized to receive the finger of an individual's hand.

* * * * *